US006792830B2

(12) United States Patent
DeKeuster et al.

(10) Patent No.: US 6,792,830 B2
(45) Date of Patent: Sep. 21, 2004

(54) UNIDIRECTIONAL RATCHET WRENCH

(75) Inventors: Michael T. DeKeuster, Racine, WI (US); Michael L. Foster, Kenosha, WI (US)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/144,298

(22) Filed: May 13, 2002

(65) Prior Publication Data

US 2003/0209108 A1 Nov. 13, 2003

(51) Int. Cl.[7] ..... B25B 13/46

(52) U.S. Cl. ..... 81/61; 81/60; 81/63.2; 81/58.4; 81/59.1; 192/43.1

(58) Field of Search ..... 81/60, 61, 63.2, 81/58.4, 59.1, 58.1; 192/43.1

(56) References Cited

U.S. PATENT DOCUMENTS

| | | | | | |
|---|---|---|---|---|---|
| 1,902,878 | A | * | 3/1933 | McNaught et al. | 81/61 |
| 3,608,403 | A | | 9/1971 | Green | 81/52.5 |
| 3,724,298 | A | * | 4/1973 | Howard | 81/63 |
| 3,763,724 | A | | 10/1973 | Green | 81/52.4 |
| 3,847,038 | A | | 11/1974 | Green | 81/52.4 |
| 4,869,138 | A | * | 9/1989 | Farris | 81/63 |
| 4,934,220 | A | | 6/1990 | Slusar et al. | 81/63.2 |
| 5,522,288 | A | | 6/1996 | Slusar et al. | 81/63 |
| 5,537,899 | A | | 7/1996 | Diedrich | 81/57.39 |
| 5,983,757 | A | | 11/1999 | Blise et al. | 81/57.39 |
| 6,070,506 | A | | 6/2000 | Becker | 81/479 |
| 6,109,141 | A | * | 8/2000 | Nurmi | 81/63 |
| 6,125,722 | A | | 10/2000 | Hopper, Jr. et al. | 81/63 |
| 6,230,591 | B1 | * | 5/2001 | Ling et al. | 81/63 |
| 6,253,647 | B1 | * | 7/2001 | Eggert et al. | 81/63 |
| 6,260,448 | B1 | * | 7/2001 | Chaconas | 81/63 |

FOREIGN PATENT DOCUMENTS

FR 1382172 11/1964

OTHER PUBLICATIONS

Snap–on #600 catalog, p. 277 (admitted prior art).

* cited by examiner

*Primary Examiner*—Joseph J. Hail, III
*Assistant Examiner*—Alvin J Grant
(74) *Attorney, Agent, or Firm*—Seyfarth Shaw LLP

(57) ABSTRACT

A ratchet wrench is provided which includes a handle having a head on the handle, a rotatable gear disposed in the head and having ratchet teeth, and a pivotable pawl engaged with the gear to allow ratcheting rotation of the gear in a first direction and prevent ratcheting rotation of the gear in a second direction. An obstruction is engageable with a cam surface at the base of the pawl in order to prevent the pawl from self-reversing.

27 Claims, 1 Drawing Sheet

UNIDIRECTIONAL RATCHET WRENCH

BACKGROUND

This application relates to hand tools and more particularly to ratcheting wrenches. It relates in particular to unidirectional ratchet wrenches and to ratchet mechanisms therefor.

Reversible ratchet wrenches have been provided with levers located in the head of the wrench to control the direction of ratcheting. However, some applications, e.g., certain torque wrenches, require operation in only one direction. For example, certain torque wrenches may be designed to apply torque in only the clockwise direction.

Unidirectional ratchet wrenches commonly have specialized pawl assemblies, which are different from the pawl assemblies in the reversible form of the ratchet wrench. This entails considerable additional expense in tooling, parts inventory and the like.

Furthermore, while unidirectional ratchet wrenches are designed to operate in only one ratcheting direction and do not have a mechanism for manual selection of ratcheting direction, they sometimes nevertheless will self-reverse under certain operating conditions. This could be harmful to the ratchet wrench, and, if the wrench is a torque wrench, could be harmful to the torque sensing mechanism. It could also be harmful to the operator and, at the very least is inconvenient, since it often requires disassembly of the ratchet mechanism in order to return the pawl assembly to its intended operating position.

Furthermore, if a unidirectional wrench tends to try to self-reverse, even while it may not reach the reverse operating condition, it may stop in a neutral position in which the pawl cannot engage the ratchet gear at all. This renders the wrench useless and again, typically requires disassembly of the ratchet mechanism in order to correct the problem.

SUMMARY

The new and improved wrench of the present application in an embodiment provides for a ratchet wrench comprising a head having a drive member, a rotatable gear disposed in the head and having gear teeth, a pawl disposed in the head in an operating condition in which the pawl is pivotally engageable with the gear to allow torque-applied loading of the gear with the head in a first direction and ratcheting rotation of the head relative to the gear in an opposite direction and an obstruction disposed within the head for engagement with the pawl to prevent the pawl from moving from its operating condition.

The wrench in an embodiment includes a pawl that includes a cam surface having a shape that permits the pawl to be biased to a first pawl operating condition accommodating torque application when the wrench is rotated in one direction and ratcheting operation when the wrench is rotated in the opposite direction. The wrench in an embodiment provides for the pawl to be prevented from moving from the first operating condition by the obstruction abutting the cam surface. The pawl in an embodiment includes teeth which are engageable with the gear teeth of the rotatable gear, the obstruction not interfering with the normal unidirectional ratcheting operation.

The wrench in an embodiment provides an obstruction that prevents self-reversal of the pawl. The wrench in an embodiment provides a pawl that includes inoperative teeth which are prevented from engaging the gear by the obstruction. The wrench in an embodiment provides an obstruction that is a pin formed of a hard metallic material. The wrench in an embodiment provides a pawl that includes a pair of cam surfaces and teeth to engage gear teeth of the gear. The wrench in an embodiment provides a first cam surface that engages the obstruction when the pawl is rotated in the first direction for limiting such rotation. The wrench in an embodiment provides a second cam surface that engages a biasing mechanism to accommodate ratcheting oscillation of the pawl.

The present application in an embodiment also provides for a unidirectional ratchet assembly comprising a rotatable gear having ratchet teeth, a pivotable pawl movable to an operative pawl position allowing for ratcheting rotation of the gear in a first direction and a non-reversing means disposed to interfere with the movement of the pawl to prevent the pawl from being moved to a non-operative pawl position and to prevent rotation of the gear in a second direction. The assembly in an embodiment provides a non-reversing means that comprises an obstruction provided adjacent to the pawl and wherein the obstruction engages a cam surface of the pawl in order to prevent rotation to the non-operative pawl position.

The present application in an embodiment also provides for a method of converting a reversible ratchet wrench to a non-reversible ratchet wrench comprising the steps of providing a wrench having a handle and a head on the handle, providing a rotating gear disposed in the head, providing a pawl initially rotatable between a first pawl position allowing for ratcheting rotation of the gear past the pawl in a first direction and a second pawl position allowing for ratcheting rotation of the gear past the pawl in a second direction and inserting an obstruction member within the head in order to prevent the rotation of the pawl to the second pawl position.

The conversion method in an embodiment provides a pawl that includes engagement teeth and inoperative teeth. The conversion method in an embodiment provides an obstruction member that includes a pin and further comprising the step of locating the pin within the head in order to prevent the pawl from rotating to the second pawl position and maintaining the engagement teeth of the pawl in engagement with the gear. The conversion method in an embodiment further comprises the step of locating the pin within the head to prevent the pawl from rotating to the second pawl position in order to prevent the inoperative teeth of the pawl from engaging the gear. The conversion method in an embodiment comprises the further step of locating the pin within the head to prevent the pawl from rotating to an intermediate pawl position in which the gear could rotate freely in either direction.

The unidirectional ratchet wrench consists of certain novel features and a combination of parts hereinafter described, illustrated in the accompanying drawings, and particularly pointed out in the appended claims, it being understood that various changes in the details may be made without departing from the spirit, or sacrificing any of the advantages of the unidirectional wrench.

BRIEF DESCRIPTION OF THE DRAWINGS

For the purpose of facilitating an understanding of the unidirectional ratchet wrench, there is illustrated in the accompanying drawings an embodiment thereof, from an inspection of which, when considered in connection with the following description, its construction and operation, and many of its advantages should be readily understood and appreciated.

DETAILED DESCRIPTION

Figure 1:
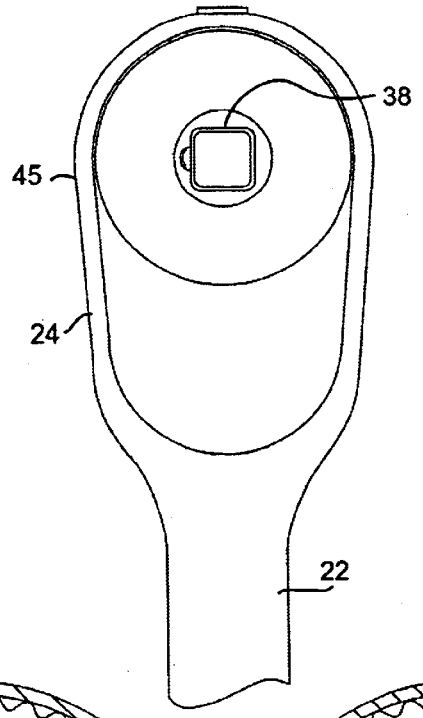
FIG. 1 is a fragmentary bottom plan view of a unidirectional ratchet wrench having the handle cut-away.
Figure 2:
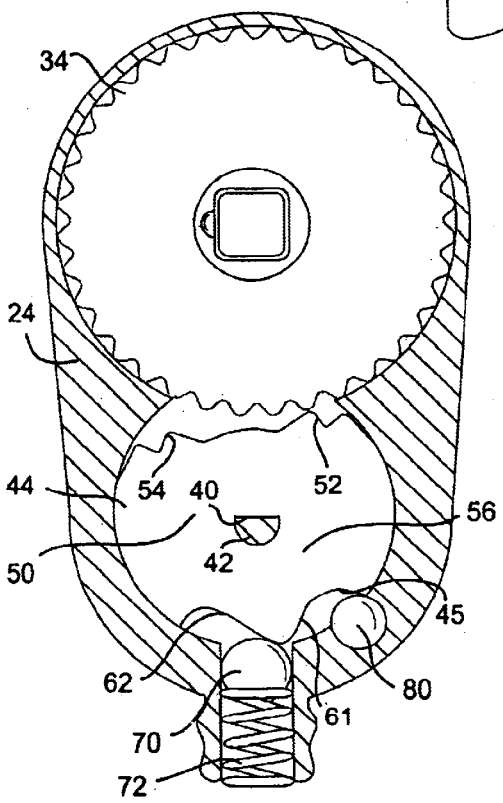
FIG. 2 is an enlarged cutaway view of the head of the wrench of FIG. 1 showing the pawl in a disengaged position.
Figure 3:
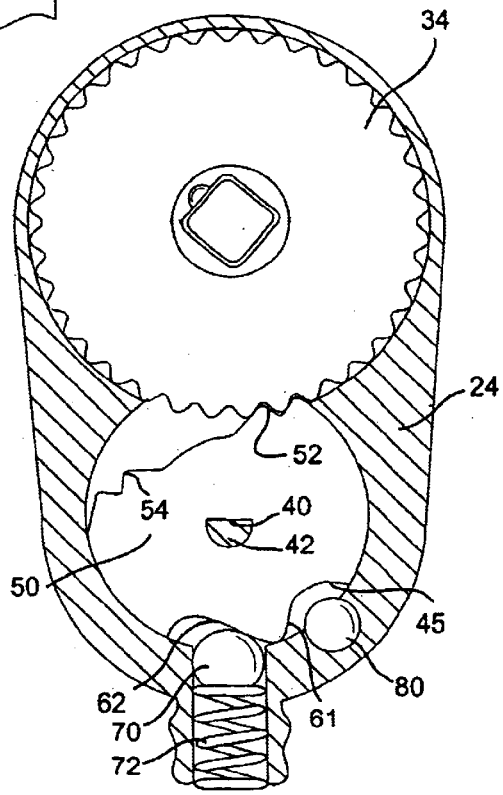
FIG. 3 is a view similar to FIG. 2 showing the pawl in an engaged position.

Referring to FIGS. 1–3, an embodiment of a unidirectional ratchet wrench is illustrated. In this embodiment a ratchet wrench 20 is illustrated. However, the present device may be used for any type of unidirectional or non-self reversing ratchet wrench assembly, such as a split beam torque wrench. The ratchet wrench 20 includes a handle 22 coupled to a head 24. The head defines a cavity 30 including a part-cylindrical portion 32 communicating with a part-cylindrical portion 33. Disposed in the cavity 30 is a ratchet assembly 35, which includes a rotatable gear 34 having teeth 36 and a square drive member 38 for engaging an associated socket or other tool (not shown). A pawl 44 is disposed in the cavity portion 33 and the pawl also has a smaller, substantially part-cylindrical opening 40 therein housing a pawl pin 42. In an embodiment the pawl 44 is rotatable about the axis of the pawl pin 42. However, in other embodiments the pawl may be mounted in a pivotal manner whether or not it is also rotatable about its axis. The rotatable gear 34, the pawl pin 42 and the pawl 44 are retained within the head 24 by a cover plate 46 fixed to the head by fasteners (not shown). The pawl pin 42 and pawl 44 in an embodiment may be a one-piece construction.

The pawl 44 has a first-side 50 with engagement teeth 52 and inoperative teeth 54 and a second opposite side 56 with a pair of cam surfaces 61, 62. The pawl 44 has an upper surface and a lower surface defining the thickness of the pawl 44. In FIG. 2, the rotatable gear 34 is shown adjacent to the pawl 44 with the pawl in a position where none of the pawl teeth 52, 54 are engaging with the gear teeth 36. In an embodiment a point 45 of the first cam surface 61 is engageable with an obstruction 80 disposed in the head 24. In normal operation the pawl 44 may rotate in its operating condition between a disengaged position (FIG. 2) wherein the engagement teeth 52 are out of engagement with the gear 34, and an engaged position (FIG. 3) wherein the engagement teeth 52 engage the gear 34. In an embodiment, the obstruction 80 may be a pin. In other embodiments an obstruction member may include a ball or a protruding portion of the head formed integrally with the head 24 or formed as one-piece with the head 24, or a member on the cover plate 46.

During ratcheting movement of the wrench 20, the pawl 44 oscillates between the FIG. 3 and FIG. 2 operating positions. Upon rotation from the engaged position of FIG. 3 to the disengaged position of FIG. 2, the pawl 44 second cam surface 62 interacts with a bias mechanism including a ball 70 which is biased against the pawl 44 by a compression spring 72. As the engaged tooth or teeth 36 of the gear 34 cams past the pawl tooth or teeth 52, spring 72 causes the ball 70 to ride on the second cam surface 62 to urge the pawl 44 back toward the FIG. 3 position in engagement with the next tooth or teeth of the gear 34, all in a known manner. The bias mechanism acts to bias the pawl 44 toward engagement with the gear 34.

The disengaged position of the pawl of FIG. 2 during ratcheting is distinguished from a fully rotated position (not shown) in which the pawl 44 has self-reversed. For example, if the obstruction 80 was not present, the pawl 44 might self-reverse and rotate clockwise until the inoperative pawl teeth 54 engage the gear teeth 36. Prior to the engagement of the inoperative pawl teeth 54, the pawl 44 would be oriented in an intermediate or non-operative or neutral position (not shown) in which none of the pawl teeth 52, 54 are engaged, nor even abut the gear teeth 36. In such an intermediate pawl position the gear 34 may move freely clockwise or counterclockwise without ratcheting. Movement of the gear 34 to such an intermediate position is prevented by engagement of the obstruction 80 against the pawl 44, which also prevents self-reversing of the pawl 44. In the embodiment disclosed in FIG. 2, the obstruction 80 is mounted in a recess provided adjacent to the ball 70. The first cam surface 61 is shaped and the obstruction 80 is positioned so that the pawl 44 may oscillate a sufficient distance to permit ratcheting, as explained above. As shown in FIG. 2, the engagement teeth 52 are out of contact with the gear 34 and the pawl 44 is rotated clockwise to a position such that a point 45 on the pawl cam surface 61 is abutting against obstruction 80 restricting the pawl 44 from rotating any further in the clockwise direction. Thus, the gear 34 may ratchet past the pawl 44 only in a counterclockwise direction. The ball 70 provides continuous pressure on the cam second surface 62 to urge the pawl 44 back to the engaged position (FIG. 3) preventing clockwise rotation of the gear 34 and allowing for the wrench to have a fixed working mode wherein the head 24 and gear 34 move together to apply torque only in a counterclockwise direction.

FIG. 3 discloses the same elements of FIG. 2, however the pawl 44 is rotated in its furthermost counterclockwise position. It can be seen that the pawl teeth 52 are engaging with the gear teeth 36. The cam surface 61 of the pawl 44 is separated from the obstruction 80 allowing for counterclockwise rotation of the gear 34. The obstruction 80 does not obstruct engagement of the pawl 44 with the gear 34. In the orientation shown in FIG. 3, the pawl 44 allows for the gear 34 to rotate in the counterclockwise direction. The obstruction 80 restricts the pawl 44 from self-reversing which would allow the gear 34 to rotate in the counter-clockwise direction. The obstruction 80 is held in place by mounting it in its own cavity in ratchet head 24 such that the obstruction 80 is disposed for engagement with the first cam surface 61 at point 45 of the pawl 44. Without the obstruction 80, the pawl 44 might, under certain conditions, tend to continue to rotate clockwise sufficiently to self-reverse so that the engagement teeth 54 would be engageable with the gear 34. The obstruction 80 abuts against point 45 of the pawl 44 and prevents such self-reversal of the pawl 44. The cover plate 46 is placed over the recess 30 and contains the gear 34 and the pawl 44 in the cavity 30 and, if need be, retains the obstruction 80 in place.

It may be understood that the inoperative teeth 54 of the pawl have no use. Such pawls 44 with teeth on both sides are presently manufactured and designed for use in reversible ratchet wrenches. It is less expensive to use the pre-existing reversible pawl 44 than to retool a new pawl with only engagement teeth 52. However, in another embodiment, it may also be desirable to provide a unidirectional ratchet wrench which ratchets in the opposite direction from the wrench 20. In such an embodiment, a pawl with engagement teeth 54 would be required. In such an alternate embodiment, it is even more evident that using a pawl 44 that has teeth on both sides 52, 54 of the pawl saves tooling expenses, instead of requiring two different pawls. In that alternate embodiment, the obstruction 80 would be located on the opposite side of the ball 70 for engagement with a point on the cam surface 62.

It should further be understood that the present device may provide a quick and inexpensive method of converting a bidirectional ratchet wrench to a unidirectional wrench. Standard ratchet-type wrenches may be provided for different applications which may utilize a one-way or unidirectional ratchet wrench. By placement of the obstruction 80 for engagement with the pawl as discussed above, a standard reversible bi-directional wrench may be converted to a non-reversing, unidirectional clockwise wrench, without expensive retooling of components. Likewise, by placing the obstruction 80 on the opposite side of the bias ball, a wrench may be converted easily to a counterclockwise non-self-reversing wrench.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A unidirectional ratchet wrench comprising:

a head having a drive member for applying torque to a workpiece;

a rotatable gear disposed in the head and having gear teeth;

a bidirectional pawl disposed in the head in a first operating condition in which the pawl is pivotally engageable with the gear to allow torque-applying rotation of the gear with the head in a first direction;

a bias member adjacent the pawl to allow ratcheting rotation of the head relative to the gear in a second direction, wherein the first operating condition also includes the ratcheting rotation; and an obstruction disposed within the head for engagement with the pawl to prevent the pawl from moving from the first operating condition to a second operating condition in which the pawl may allow ratcheting rotation of the head relative to the gear in the first direction.

2. The wrench of claim 1, wherein the pawl includes a cam surface and a bias mechanism engageable with the cam surface for biasing the pawl toward engagement with the gear.

3. The wrench of claim 2, wherein the pawl includes teeth which engage the gear teeth of the rotatable gear.

4. The wrench of claim 3, wherein the pawl is prevented from moving from the operating condition by the obstruction abutting the cam surface.

5. The wrench of claim 1, wherein the pawl includes an engagement tooth which is engageable with one or more gear teeth of the rotatable gear.

6. The wrench of claim 5, wherein the pawl includes plural engagement teeth.

7. The wrench of claim 1, wherein the obstruction prevents self-reversal of the pawl.

8. The wrench of claim 1, wherein the pawl includes an inoperative tooth which is prevented from engaging the gear by the obstruction.

9. The wrench of claim 1, wherein the obstruction is a pin formed of a hard metallic material.

10. The wrench of claim 2, wherein the pawl includes a pair of cam surfaces and plural teeth to engage one or more gear teeth of the gear.

11. The wrench of claim 10, wherein a first cam surface is engageable with the obstruction for limiting rotation of the pawl in the first direction.

12. The wrench of claim 10, wherein a second cam surface engages a ball resiliently mounted adjacent the pawl to accommodate ratcheting oscillation of the pawl.

13. A unidirectional ratchet assembly comprising:

a rotatable gear having ratchet teeth;

a bidirectional, pivotable pawl disposed in an operative condition allowing for ratcheting movement of the pawl relative to the gear in a first direction; and a non-reversing means disposed to interfere with the movement of the pawl to prevent the pawl from being moved to a non-operative pawl condition and to prevent ratcheting movement of the gear relative to the pawl in a second direction.

14. The assembly of claim 13, wherein the non-reversing means comprises an obstruction provided adjacent to the pawl and wherein the obstruction is engageable with a cam surface of the pawl in order to prevent rotation to the non-operative pawl condition.

15. The assembly of claim 14, and further comprising a ball resiliently urged against the pawl to permit oscillation of the pawl to provide for ratcheting of the gear.

16. The assembly of claim 14, wherein the obstruction includes a pin mounted adjacent to the pawl.

17. The assembly of claim 13, wherein the ratchet assembly is provided in a torque wrench.

18. The assembly of claim 17, wherein the torque wrench is a beam style wrench.

19. A method of converting a reversible ratchet wrench to a non-reversible ratchet wrench comprising the steps of:

providing a wrench having a handle and a head on the handle;

providing a rotatable gear disposed in the head;

providing a pawl initially rotatable between a first pawl condition allowing for ratcheting rotation of the gear past the pawl in a first direction and a second pawl condition allowing for ratcheting rotation of the gear past the pawl in a second direction; and inserting an obstruction member within the head in order to prevent the rotation of the pawl to the second pawl condition.

20. The conversion method of claim 19, wherein the pawl includes engagement teeth and inoperative teeth.

21. The conversion method of claim 20, wherein the obstruction member includes a pin and further comprising the step of locating the pin within the head in order to prevent the pawl from rotating to the second pawl condition.

22. The conversion method of claim 21 further comprising the step of locating the pin within the head to prevent the pawl from rotating to the second pawl condition in order to prevent the inoperative teeth of the pawl from engaging the gear.

23. The conversion method of claim 21 comprising the further step of locating the pin within the head to prevent the pawl from rotating to an intermediate pawl position in which the gear could rotate freely in either direction.

24. A unidirectional ratchet wrench comprising:

a head having a drive member for applying torque to a workpiece;

a rotatable gear disposed in the head and having gear teeth;

a pawl disposed in the head in an operating condition in which the pawl is pivotally engageable with the gear to allow torque-applying rotation of the gear with the head in a first direction;

a bias member adjacent the pawl to allow ratcheting rotation of the head relative to the gear in a second direction, wherein the first operating condition also includes the ratcheting rotation;

a cam surface provided on the pawl and a bias mechanism engageable with the cam surface for biasing the pawl toward engagement with the gear; and an obstruction disposed within the head for engagement with the pawl to prevent the pawl from moving from the first operating condition.

25. A unidirectional ratchet wrench comprising:

a head having a drive member for applying torque to a workpiece;

a rotatable gear disposed in the head and having gear teeth;

a pawl disposed in the head in first operating condition in which the pawl is pivotally engageable with the gear to allow torque-applying rotation of the gear with the head in a first direction;

a bias member adjacent the pawl to allow ratcheting rotation of the head relative to the gear in a second direction, wherein the first operating condition also includes the ratcheting rotation;

an obstruction disposed within the head for engagement with the pawl to prevent the pawl from moving from the first operating condition; and an inoperative tooth provided on the pawl, the tooth prevented from engaging the gear by the obstruction.

26. A unidirectional ratchet wrench comprising:

a head having a drive member for applying torque to a workpiece;

a rotatable gear disposed in the head and having gear teeth;

a bidirectional pawl disposed in the head in a first operating condition in which the pawl is pivotally engageable with the gear to allow torque-applying rotation of the gear with the head in a first direction;

a bias member adjacent the pawl to allow ratcheting rotation of the head relative to the gear in a second direction, wherein the first operating condition also includes the ratcheting rotation; and an obstruction including a pin formed of a hard metallic material disposed within the head for engagement with the pawl to prevent the pawl from moving from the first operating condition.

27. A unidirectional ratchet assembly comprising:

a rotatable gear having ratchet teeth;

a pivotable pawl disposed in an operative condition allowing for ratcheting movement of the pawl relative to the gear in a first direction;

a non-reversing means disposed to interfere with the movement of the pawl to prevent the pawl from being moved to a non-operative pawl condition and to prevent ratcheting movement of the gear relative to the pawl in a second direction; and the non-reversing means comprises an obstruction provided adjacent to the pawl and wherein the obstruction is engageable with a cam surface of the pawl in order to prevent rotation to the non-operative pawl condition.

* * * * *